US005909875A

United States Patent [19]

Weingardt

[11] Patent Number: 5,909,875

[45] Date of Patent: Jun. 8, 1999

[54] KENO GAME

[76] Inventor: Gary Weingardt, 5416 Gipsy Ave., Las Vegas, Nev. 89107

[21] Appl. No.: 08/939,077

[22] Filed: Sep. 26, 1997

Related U.S. Application Data

[63] Continuation-in-part of application No. 08/569,793, Dec. 8, 1995, Pat. No. 5,727,786, and application No. 08/366,982, Dec. 29, 1994, abandoned, and application No. 08/182,850, Jan. 18, 1994, Pat. No. 5,482,289.

[51] Int. Cl.[6] ..... A63F 3/06

[52] U.S. Cl. ..... 273/269; 273/274

[58] Field of Search ..... 273/269, 274, 273/270, 148 R, 292

[56] References Cited

U.S. PATENT DOCUMENTS

| | | | |
|---|---|---|---|
| 1,655,380 | 4/1928 | Parker . | |
| 4,019,744 | 4/1977 | Pizur, Sr. | 273/135 |
| 5,029,871 | 7/1991 | Wilson, Jr. | 273/271 |
| 5,127,656 | 7/1992 | Simpson | 273/269 |
| 5,160,146 | 11/1992 | Greer | 273/269 |
| 5,351,970 | 10/1994 | Fioretti | 273/439 |
| 5,569,083 | 10/1996 | Fioretti | 463/19 |

OTHER PUBLICATIONS

Scarnes New Complete Guide to Gambling, pp. 182–199, 432–441, copyright 1961.

Scarnes New Complete Guide to Gambling, pp. 205–223, copyright 1974.

Scarne's New Complete Guide to Gambling "Keno : Nevada's Solitaire Bingo–Type game" (New York: Simon & Schuster) 1974, pp. 490–493.

*Primary Examiner*—William M. Pierce

*Attorney, Agent, or Firm*—John Edward Roethel

[57] ABSTRACT

All of the possible keno numbers are displayed on an electronic reader board in the keno game room or on the electronic keno gaming machine. After each player has marked his keno ticket and prior to the start of drawing keno balls, an electronic random number generator is used to select a predetermined group of keno numbers to be "red" numbers for that particular game. All of the other remaining keno numbers are "white" numbers for that particular game of keno. When a player achieves a winning keno ticket, the player wins certain preestablished payouts depending upon whether the player has an all "red" keno winning combination, an all "white" winning keno combination or a "mixed color" winning keno combination. A bonus jackpot feature can be also added to the method of play of keno. In one version of this bonus jackpot feature, the player wins the traditional keno payout for achieving a regular winning combination of matching numbers selected by the player. The player also wins a bonus jackpot amount if the player's matching numbers are all (or a high percentage) of the same color. In another version of this bonus jackpot feature, the player makes a separate, additional wager to be eligible for the bonus jackpot feature payouts. These bonus jackpot feature payouts can be flat amounts or progressive amounts. Progressive jackpot pools can be established for all "red" winning keno combinations or all "white" winning keno combinations or certain "mixed" color winning keno combinations.

13 Claims, 1 Drawing Sheet

KENO GAME

CROSS-REFERENCE TO RELATED APPLICATIONS

This application is a Continuation-in-Part of application Ser. No. 08/569,793, filed Dec. 8, 1995, entitled "Bingo Game", now U.S. Pat. No. 5,727,786, and a Continuation-in-Part of application Ser. No. 08/366,982, filed Dec. 29, 1994, entitled "Bingo Game", now abandoned, and a Continuation-in-Part of application Ser. No. 08/182,850, filed Jan. 18, 1994, entitled "Bingo Game", now Pat. No. 5,482,289.

BACKGROUND OF THE INVENTION

This invention also relates to a keno game, and more particularly to a keno game that utilizes progressive jackpot pools and increases the attractiveness of the game to the players.

Conventional keno is a well known game. In conventional keno, there are eighty numbers in the pool—typically eighty keno balls numbered 1 through 80 and maintained in a air blower device that circulates the keno balls. Twenty of the eighty keno balls are selected each game.

Each player marks a keno ticket that is an 8×10 matrix with all eighty numbers printed thereon. The player selects between one and fifteen numbers that the player thinks will be drawn during the game. The player makes an appropriate wager. Depending on the number of matches between the twenty numbers drawn and the numbers selected by the player, the player wins or loses. The more numbers that match, the higher the payoff to the player. In keno, unlike in bingo which is keno's related number drawing game, there is no requirement that the numbers that are drawn must appear in certain patterns on the keno ticket. However in keno, also unlike bingo in which numbers are drawn until a winner occurs, only twenty numbers are drawn each keno game so there is no guarantee that a player will win each game.

In live keno, multiple players participate each game and no players may win, some players may win or all players may win. In traditional live keno, players may select between one and fifteen numbers and wagers can range from as little as 35¢ a game to $5, $10 or even higher dollars per game. Typically each establishment operating a keno game will provide for the players a payout chart showing the amount possible to be won by the player based on the amount wagered, the number of numbers selected by the player and the number of matches achieved by the player when the twenty keno balls are selected. For example, if the player wagers $1 and selects one number, the player will typically win $3 if his one number is one of the twenty keno balls drawn during the play of the game. Similarly, if the player selects fifteen numbers, the player will typically be paid if anywhere between a total of eight and fifteen of his numbers match the twenty keno balls drawn. The highest payout will be made for matching fifteen out of fifteen, with lower payouts made for matching fourteen out of fifteen, thirteen out of fifteen and so on down to eight out of fifteen. Any matches of seven or less are losing plays. Similar payout schemes are provided for selections by the player of between one and fifteen numbers.

In electronic keno, a single player plays against the gaming machine for each round of the game and the player either wins or loses each round. The electronic controls of the gaming machine randomly select twenty numbers from the pool of eighty numbers and determine whether the player has achieved a winning payout at the conclusion of each round of the game. The player wagers a coin, token or credit and selects the number of numbers that the player is attempting to match during that round of the game. The selection is made by using a light pen, or pressing the numbers on a selection panel or touching the numbers selected using conventional touch screen technology. In the typical electronic keno format, the player may select between one and ten numbers to attempt to match. When the player presses the "Start" button, the electronic controls of the gaming machine select twenty numbers from the total pool of eighty numbers. Just as in live keno, the player wins when he matches all or a predetermined minimum number of his selected numbers. If the player matches less than the predetermined minimum number of his selected numbers, then the player loses.

Conventional bingo is also a well known game and is related to keno. In conventional bingo, players are provided with bingo cards that have a matrix of five rows and five columns. The columns are lettered B I N G O from left to right across the top of the matrix and each bingo card has five numbers in each row except the center column which has a "free space" at the intersection of the third row and the third column.

Bingo balls individually numbered 1–75 are mixed together and balls are selected one at a time. As each ball is selected, the number is announced to the players, who cover any corresponding number on their bingo card. When a player achieves a predetermined arrangement of covered spots on his bingo card, that player yells out "Bingo!" and he wins he game.

In the conventional manner of play of bingo, in order to win the game, a player must cover five spaces in a vertical column, a horizontal row or along one of the two diagonals of the bingo card. The free space in the center of the bingo card allows a player to win with as few as four numbers being drawn. Other winning combinations include the four corners of the bingo card and the eight numbers immediately adjacent and surrounding the free space. Winning combinations can also include the covering of spots on the bingo card so that letter symbols are formed such as an X, U, L, H or T.

The operator of the bingo game will designate at the beginning of the game which particular combination or combinations of covered spots will be winning combinations for that particular game. It is also popular to play "coverall" or "blackout" games in which all of the spots on the bingo card must be covered (the twenty-four spots having numbers and the center free space) in order for the player to win.

There is a need to increase the player appeal of keno in order to generate increased revenues from the operation of the game. Increased player participation would allow the payment of higher payouts which in turn would generate more player participation.

It is an object of the present invention to provide a method of playing keno and an improved keno apparatus that will increase the player participation in the game.

It is a further object of the present invention to increase the popularity of keno by increasing the difficulty factor of getting a winning keno ticket, to allow for prizes high enough to attract gamblers away from other types of gaming such as video poker, slot machines and live table games, and to compete with lotteries.

It is a feature of the present invention to provide a large electronic display board on which all of the possible keno ball numbers are displayed. Prior to each game, some of the numbers on the display board are specially designated with a first distinctive marking and the remaining numbers on the display board are specially designated with a second distinctive marking. These special designations are accomplished by means of an electronic random number generator so that chance is introduced into the selection of which numbers receive the first distinctive marking and the second distinctive marking.

It is a further feature of the present invention to provide a bonus jackpot feature, that can either be a progressive jackpot or flat jackpot amount, to the game of keno for which the player is automatically eligible for the bonus jackpot simply by playing the game of keno or by which the player can become eligible for the bonus jackpot by making a separate wager in addition to the regular wager for the regular keno game.

It is a further object of the present invention to provide that the wagers made by the player are used to fund the special payouts made to the player for certain winning keno combinations. In one form, the wager is split between the payouts for a regular keno game and the bonus jackpot payouts for certain pre-designated winning combinations. In another form, a first wager makes the player eligible for payouts on the regular keno game and a second optional wager makes the player eligible for bonus jackpot payouts for certain pre-designated winning combinations.

It is an advantage of the present invention that the additional features added to the keno game will allow more and higher payouts to be made by the gaming establishment or the keno game operator. This will result in increased player participation and additional revenues to the gaming establishment or keno game operator.

Other objects, features and advantages of the present invention will become apparent from a consideration of the following detailed description.

The present invention is a refinement of the principles and concepts described in the applicant's previous applications for patents, viz. U.S. application Ser. No. 08/182,850, filed Jan. 18, 1994, entitled "Bingo Game", now Pat. No. 5,482,289 and U.S. application Ser. No. 08/569,793, filed Dec. 8, 1995, entitled "Bingo Game", now pending. The disclosure of each of these patents is incorporated herein by this reference.

SUMMARY OF THE INVENTION

All of the possible keno numbers are displayed on an electronic reader board in the keno game room or on the electronic keno gaming machine. After each player has marked his keno ticket and prior to the start of drawing keno balls, an electronic random number generator is used to select a predetermined group of keno numbers to be "red" numbers for that particular game. All of the other remaining keno numbers are "white" numbers for that particular game of keno.

When a player achieves a winning keno ticket, the player wins certain preestablished payouts depending upon whether the player has an all "red" keno winning combination, an all "white" winning keno combination or a "mixed color" winning keno combination.

A bonus jackpot feature can be added to the method of play of keno. In one version of this bonus jackpot feature, the player wins the traditional keno payout for achieving a regular winning combination of matching numbers selected by the player. The player also wins a bonus jackpot amount if the player's matching numbers are all (or a high percentage) of the same color. In another version of this bonus jackpot feature, the player makes a separate, additional wager to be eligible for the bonus jackpot feature payouts. These bonus jackpot feature payouts can be flat amounts or progressive amounts. Progressive jackpot pools can be established for all "red" winning keno combinations or all "white" winning keno combinations or certain "mixed" color winning keno combinations.

DETAILED DESCRIPTION OF THE PREFERRED EMBODIMENTS

Figure 1:
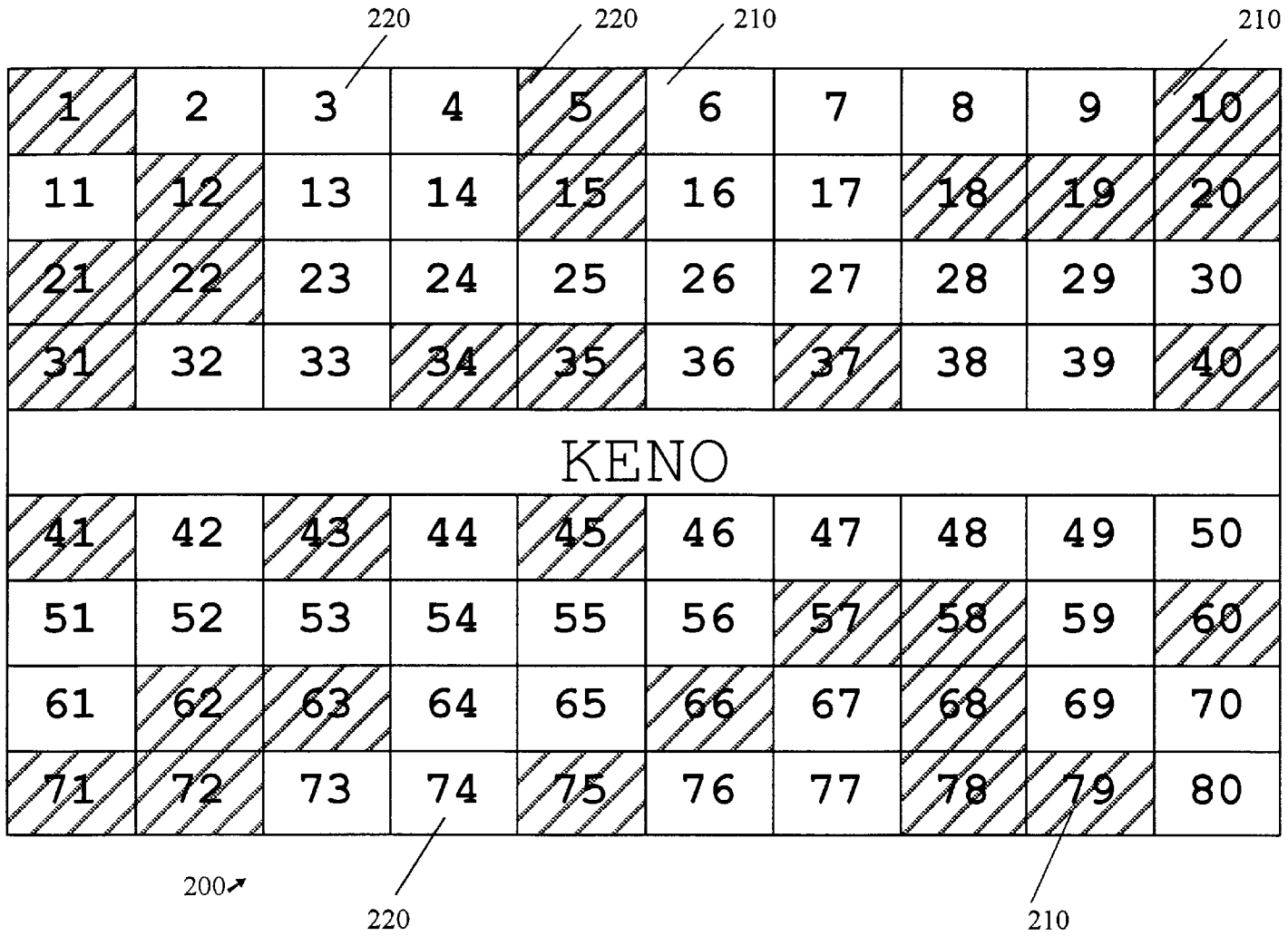
FIG. 1 shows an electronic keno number display board programmed to show which keno numbers have been selected as the "red" numbers and which keno numbers remain as the "white" numbers and used in the practice of the present invention.

The method and apparatus of the present invention is designed to increase the player appeal and to enhance the revenue generated to the operator of a keno game. While similar to conventional keno, the present invention adds unique winning keno combinations and allows for the payout to the player of large jackpots, either in flat amounts or as progressive jackpots which increase from game to game until won by some lucky player.

FIG. 1 shows the electronic keno number display board 200 that is used in the room or hall in which the keno game of the present invention is being conducted. The display board 200 is modeled after a conventional electronic keno display board used in an eighty number keno game in that there is an 8×10 matrix that comprises a conventional eighty number keno set.

The electronic controls that operate this keno board 200 include a conventional random number generator that is programmed to randomly select from the eighty number set a group of keno numbers to be designated with a first designated marking for a particular game. All numbers not selected remain with their original designation on the keno board 200 and are considered the group of numbers with the second designated marking.

In the preferred embodiment of the present invention, a total of between thirty and forty of the keno numbers, and in the most preferred embodiment thirty numbers, are predetermined each game to be the "red" numbers (the first designated marking). Whatever numbers are remaining are left as the "white" numbers, which in the most preferred embodiment would be fifty numbers (the second designated marking).

For example, as shown in FIG. 1, thirty numbers have been designated as "red" numbers 210. The remaining fifty bingo numbers are left as "white" or regular numbers 220.

Of course, there is nothing critical about the use of "red" and "white" as the designators for the numbers on the electronic keno reader board 200. Any suitable markings can be used, as long as the players can differentiate between the markings on the reader board 200. For example, depending on the type of electronic reader board 200 that is being used, it may be easier to use letters or other character symbols as the markings used to designate the various numbers, especially if a monochromatic reader board is used.

The electronic controls that operate the electronic keno reader board illuminate the selected "red" numbers as the color red. The remaining numbers are left as "white" which is the initial color of all the numbers on the electronic reader board. Each player can then see when the numbers are designated which of the keno numbers have the various distinctive markings.

As an alternative to using electronic controls and an electronic random number generator to determine which numbers will have the first designated marking and which numbers will have the second designated markings, other methods and devices can be used. For example, at the beginning of each keno game, two keno ball blowers can be provided. One blower has the eighty numbered keno balls and the other blower has eighty colored balls having the same color distribution as the desired ratio between "red" numbers and "white" numbers. In the preferred embodiment, there would be thirty "red" balls and fifty "white" balls. Every time a numbered keno ball is drawn from the first blower, one of the colored balls is drawn from the second blower. Thus each keno number that is drawn will be associated with a color. At the time that the keno reader board is illuminated to shown which number has been drawn, it will also be illuminated to show whether the drawn number is to be considered a "red" number or a "white" number for that game.

Other combinations of mechanical and electronic methods and devices can also be used to designate the first designated markings and the second designated markings either prior to the keno numbers being drawn or concurrently with the keno numbers being drawn.

Prior to the selection of which numbers will be "red" numbers and which numbers will remain "white" numbers, each player marks a keno ticket in the conventional manner by selecting one or more numbers to be active for that player during the game. The player then turns the keno ticket into the keno booth and makes a wager. After the appropriate length of time, the keno game is "closed" by the operator. Before any keno balls are selected but after the game has been "closed", the electronic game controls randomly select which numbers will be "red" and which numbers will remain "white" for that particular game.

The game then begins in the conventional manner with the keno caller announcing the keno numbers which have been selected sequentially during the play of the game. The keno numbers can be selected in any conventional manner such as using a keno ball air blower or by using electronic random number technology that selects twenty of the possible eighty numbers. As soon as twenty numbers have been selected, the game ends.

If the player has a winning combination on his keno ticket based on the numbers drawn during that particular game, the player wins. The amount won by the player depends on whether the player's winning keno combination are all "red" numbers, all "white" numbers or a mixture of "red" and "white" numbers, i.e. a "mixed" color winning keno combination.

For example, a player can initially select ten numbers on a keno ticket and make a $1.00 wager. In conventional keno, the player will receive a payout on his ten number keno ticket if he matches either five, six, seven, eight, nine or ten of the twenty numbers randomly drawn during the play of the game.

In the method of the present invention, after the player turns in his keno ticket marked with ten numbers, the electronic controls randomly select thirty of the eighty possible numbers to be "red" numbers for that particular game. The remaining fifty numbers are designated as "white" numbers for that particular game. Then twenty numbers are randomly selected.

In one embodiment of the present invention, if the player matches all ten of his numbers out of the twenty numbers selected, the player wins. The amount won by the player depends on the number of "red" numbers that the player has as winning numbers. For example, if the player's ten matching numbers are all "red", the player wins the largest bonus payout. If nine of the player's ten matching numbers are "red", the player wins the second largest bonus payout. If eight of the player's ten matching numbers are "red", the player wins the third largest bonus payout. If seven or less of the player's ten matching numbers are "red", the player wins the regular payout for achieving ten out of ten matching numbers.

Additionally, if the player were to match nine out of ten numbers, the player would win one of the bonus payouts if seven, eight or nine of the player's numbers were all "red" numbers. Otherwise, the player would win the regular payout for achieving nine out of ten matching numbers.

Similar winning payouts can be provided when the player matches less than all of the numbers he has marked.

Similar winning payouts can also be provided when the player marks less than ten numbers or more than ten numbers on his keno ticket and when the player matches all or less than all of the numbers he has marked.

The payouts can be either flat amounts or progressive amounts that increase from game to game until won by a player. The progressive amounts can be seeded to begin at a predetermined level and increase each game until won. The increase can be generated in any convenient manner; for example, a portion of each wager made by a player can be allocated to the progressive payouts. Each separate winning combination can have its own progressive payout or the progressive payout pool can be a single pool with all or various percentages of the pool being won by a player depending on what winning keno combination is achieved by the player.

Alternatively, each player can be required to make two wagers at the beginning of each game—a first wager to participate in the regular keno game and a second wager to be eligible for the progressive payout pools. In this case, the first wagers are used to fund the payouts for the normal keno game and the second wager can be allocated to the progressive payout pools.

Any of the variations of the present invention can be practiced as "house banked" games in which the operator of the keno game banks all payouts to the players. Alternatively, any of the variations of the present invention can be practiced as "parimutuel" games in which a portion of each wager is allocated to the keno operator and the remaining amount of each wager is allocated to a "parimutuel" pool or pools from which are funded the payouts to winning players, both for the regular keno game and for the bonus payouts for certain winning keno combinations.

The method and apparatus of the present invention has been described in connection with live keno. It can also be practiced using conventional video gaming machine keno format in which each player uses an electronic keno station and selects numbers and makes wagers individually. The player then presses a "Start" button and the electronic controls select the twenty numbers and show what numbers are matched by the player. These electronic keno stations can be programmed to also designate "red" and "white" numbers after the player has selected his numbers and placed a wager and before the twenty numbers are drawn. All of the features of the live keno method described above can be adapted to this electronic keno station format, including the progressive payouts. These electronic keno stations can be formatted as stand alone stations or linked to other electronic keno stations so as to provide interlinked progressive pools.

As yet another alternative to the present invention, the eighty keno balls can be pre-marked as either "red" or "white" balls prior to the start of each game. This eliminates the necessity of special electronic controls to designate "red" numbers and "white" numbers before each game.

While the preferred embodiment of the present invention uses two designated markings for the keno numbers, it is possible to practice the method of the present invention using as three, four or more designated markings.

While the invention has been illustrated with respect to several specific embodiments thereof, these embodiments should be considered as illustrative rather than limiting. Various modifications and additions may be made and will be apparent to those skilled in the art. Accordingly, the invention should not be limited by the foregoing description, but rather should be defined only by the following claims.

What is claimed is:

1. The method of playing a game of keno comprising:

a) providing a player with a keno ticket having a plurality of numbered spaces;

b) providing a plurality of keno balls each having individual numbers corresponding to the numbered spaces on the keno card;

c) providing an electronic keno number reader board having a plurality of numbered spaces corresponding to the number of keno balls used in the keno game;

d) a player making a wager to be eligible for the keno game;

e) the player selecting one or more numbers on his keno ticket to be active numbers during the game;

f) randomly designating a portion of the numbered spaces on the keno board with at least a first designated marking;

g) designating the remaining numbered spaces on the keno board as a second designated marking;

h) randomly selecting a predetermined number of keno balls;

i) if the player achieves a predetermined winning combination on the keno ticket of selected numbers having only the first designated marking, awarding the player a first preselected amount.

2. The method of claim 1 further including if the player achieves a predetermined winning combination on the keno ticket of selected numbers having only the second designated marking, awarding the player a second preselected amount.

3. The method of claim 1 in which if the player achieves a predetermined winning combination on the keno ticket of selected numbers having both the first designated marking and the second designated marking, awarding the player a third preselected amount.

4. The method of claim 1 in which a portion of the wager is allocated to a progressive pool and the player is awarded a predetermined amount of the progressive pool for achieving a predetermined winning combination.

5. The method of claim 1 in which a portion of the wager is allocated to a first progressive pool and the first preselected amount is a predetermined amount of the first progressive pool and a portion of the wager is allocated to a second progressive pool and the second preselected amount is a predetermined amount of the second progressive pool.

6. The method of playing a game of keno comprising:

a) providing a player with a keno ticket having a plurality of numbered spaces;

b) providing a plurality of keno balls each having individual numbers corresponding to the numbered spaces on the keno ticket;

c) providing an electronic keno number reader board having a plurality of numbered spaces corresponding to the number of keno balls used in the keno game;

d) a player making a first wager to be eligible for the keno game, e) a player making a second wager to be eligible for a bonus jackpot;

f) the player selecting one or more numbers on his keno ticket to be active numbers during the game;

g) randomly designating a portion of the numbered spaces on the keno number reader board with at least a first designated marking;

h) designating the remaining numbered spaces on the keno number reader board as a second designated marking;

i) randomly selecting a predetermined number of keno balls;

j) awarding an amount when the player achieves a regular winning keno combination on the keno card;

k) designating a portion of the second wager to a first bonus pool;

l) establishing first predetermined combinations as winning combinations for the first bonus pool; and m) awarding a portion of the first bonus pool to the player when he achieves one of the first predetermined winning combinations.

7. The method of claim 6 in which at least one of the first predetermined combinations comprises selected numbers having only the first designated marking.

8. The method of claim 6 in which the amount awarded to the player is a flat amount.

9. The method of claim 6 in which the amount awarded to the player is a progressive amount.

10. The method of claim 6 further comprising:

a) designating a portion of the second wager to a second bonus pool;

b) establishing second predetermined combinations as winning combinations for the second bonus pool; and c) awarding a portion of the second bonus pool to the player when he achieves one of the second predetermined winning combinations.

11. The method of claim 10 in which at least one of the second predetermined combinations comprises selected numbers having only the second designated marking.

12. The method of claim 10 in which the amount awarded to the player is a flat amount.

13. The method of claim 10 in which the amount awarded to the player is a progressive amount.

* * * * *